US006786333B2

(12) United States Patent
Davis

(10) Patent No.: US 6,786,333 B2
(45) Date of Patent: Sep. 7, 2004

(54) COMPRESSED FABRIC DISPLAY PRODUCT

(76) Inventor: Alan Davis, 9895 Olson Dr., Suite A, San Diego, CA (US) 92121

( * ) Notice: Subject to any disclaimer, the term of this patent is extended or adjusted under 35 U.S.C. 154(b) by 37 days.

(21) Appl. No.: 10/001,011

(22) Filed: Nov. 30, 2001

(65) Prior Publication Data

US 2003/0102242 A1 Jun. 5, 2003

(51) Int. Cl.[7] ..... B65D 73/00

(52) U.S. Cl. ..... 206/486; 206/497; 206/278; 206/457

(58) Field of Search ..... 206/486, 488, 206/489, 490, 497, 278, 280, 292, 294, 223, 730, 733, 734, 457

(56) References Cited

U.S. PATENT DOCUMENTS

| | | | | | |
|---|---|---|---|---|---|
| 3,056,365 | A | | 10/1962 | Galligan | |
| 3,770,118 | A | * | 11/1973 | Jones | 206/226 |
| 3,987,897 | A | * | 10/1976 | Smith | 206/497 |
| 4,702,165 | A | | 10/1987 | Anderson | |
| 4,982,659 | A | | 1/1991 | Cohen | |
| 5,031,525 | A | | 7/1991 | Kent et al. | |
| 5,316,139 | A | * | 5/1994 | Judd et al. | 206/278 |
| 5,324,378 | A | | 6/1994 | Sieber | |
| 5,344,358 | A | | 9/1994 | Jantzen | |
| 6,227,360 | B1 | * | 5/2001 | Kessler | 206/497 |
| 6,247,612 | B1 | * | 6/2001 | Kaufman | 206/497 |
| 6,442,879 | B1 | * | 9/2002 | Callendar et al. | 206/486 |
| 6,520,332 | B1 | * | 2/2003 | Barmore et al. | 206/497 |

* cited by examiner

*Primary Examiner*—Luan K. Bui
(74) *Attorney, Agent, or Firm*—Gordon & Rees LLP

(57) ABSTRACT

A promotional package has a compressed fabric article containing a hole. A flat sheet in the shape of the compressed article, and containing an opening to expose the hole, may be placed on a surface of the compressed fabric article. An object is inserted in the hole and the fabric article is wrapped in a transparent or opaque wrapping to create the promotional package and prevent the object from falling out of the package. Upon opening the promotional package containing the compressed fabric article and the object, the object can be removed and the article opened out to its original configuration.

11 Claims, 2 Drawing Sheets

COMPRESSED FABRIC DISPLAY PRODUCT

BACKGROUND OF THE INVENTION

1. Field of the Invention

The invention herein relates to display or promotional packages containing compressed fabric articles, particularly fabric articles such as garments and utility articles such as towels which are compressed into various shapes.

2. Description of the Prior Art

For the past several years there has been a growing market for compressed fabric articles for use as promotional items, souvenirs, gifts, commemorative items and the like. Typically the fabric item is a garment or a simple sheet of fabric. By far the most common are tee shirts, but other garments ("wearables") such as scarves or utility items such as towels or banners are possible or can be used. The tee shirts or other items are also commonly decorated or imprinted with a logo or wording. The fabric item may be compressed into a simple three-dimensional geometrical shape, such as a cube, ellipsoid or cylinder, but commonly it is compressed into a shape which has the general outline of a familiar object, such as a star, a car or boat, a bottle or a hand tool. The compressed article in the desired shape is wrapped into a package while in its compressed state, and once distributed for instance as a promotional item, can be unwrapped by the recipient, decompressed and opened out to its original configuration as the real shirt, towel, etc. that is. The recipient therefore sees and enjoys the unique compressed shape of the original package, recognizes the advertising or other message intended by the vendor for the compressed package, and then after opening the packaging also obtains the benefit of having a usable garment, towel or other useful fabric product.

As will be recognized, since fabric cannot be formed into a body having particularly sharp corners, and since many common items have detailed and complex shapes, the compressed package merely simulates the overall outline of the familiar object. It is common for vendors to place a flat sheet insert having a picture of the familiar object adjacent to one or more outer surfaces of the compressed fabric article, so that when the compressed fabric article is covered by a transparent package wrapping the picture will be visible through the wrapping and reinforce the recipient's recognition of the shape or object that the compressed fabric article is intended to represent.

It is also known for such compressed fabric articles to have other objects, usually of a similar shape, included in the same package, so that the recipient of the packaged article received not only the fabric shirt, towel, etc., but also another promotional item at the same time. Such included items are commonly flat and are placed on the flat surface of the fabric article. These items may include money, CDs, video or audio cassettes. Such items are of course packaged with the compressed fabric article after compression of the latter has been completed.

Typical examples of compressed fabric articles of the types described above, both with and without sheet inserts or other promotional items included in their packaging, are found in my previously issued design patents, including but not limited to those articles shown in U.S. Design Pat. Nos. D-411,799 (Jul. 6, 1999), D-432,931 (May 2, 2000); D-431,185 (Sep. 26, 2000); D-431,186 (Sep. 26, 2000); D-431,187 (Sep. 26, 2000); D-431,456 (Oct. 3, 2000); D-431,773 (Oct. 10, 2000); and D-431,774 (Oct. 10, 2000).

Heretofore, however, it has never been considered that shapes, graphics, pictures or other indicia could be incorporated into a compressed fabric in any manner other than by means of the general outer shape of the compressed package or by means of a preprinted insert sheet. No vendor or compressed fabric products has heretofore disclosed or suggested any manner in which the fabric item itself—i.e., the shirt, towel, etc.—could have a hole containing an object.

SUMMARY OF THE INVENTION

I have now developed a promotional or display package with a compressed fabric body having a hole to store an object. The hole is generally located in the center of the compressed fabric article, but may also be located towards one particular side of the fabric article. Typically the object has substantially the same shape as the hole and may or may not protrude above the surface of the fabric body. A transparent or opaque wrapping is placed around the package so the object is maintained. The package continues to retain its shape until the recipient of the package opens it, removes the object and opens up the fabric body to expose its true shirt, towel, etc. nature. The hole does not harm the surface of the fabric body in any manner, and the fabric body will return to its original shape once the recipient has removed the package wrapping and opened out the fabric body.

The original fabric body may be of any compressible fabric material, such as a woven or felted fabric. The most preferred fabric is cotton, which is inexpensive, readily resumes its shape and eliminates creases and wrinkles after opening. However, it is also contemplated that other natural, synthetic, metallic, etc. fabrics may also be used, individually or in blends. For instance, blends of cotton with synthetic fibers, such as polyester fiber, are contemplated. Fabrics may be woven, felted or otherwise formed by conventional methods. The critical requirement is that the fabric chosen must be sufficiently flexible to be able to be highly compressed into a small package with (usually) an irregular shape without adverse effects to the overall fabric or the individual fibers from which it is made. Other properties, such as cost or ability to eliminate wrinkles and creases after opening, may be important or not in the view of individual users of the products. While it will thus be recognized that there are many suitable fabrics, for brevity herein the invention will be exemplified in its most common embodiment, i.e., as a cotton fabric product, namely a tee shirt.

In the preferred embodiment of the present invention, one compresses a fabric article by known methods in the art in the shape of a familiar object. For example, in the Figures of this application, the compressed fabric article is illustrated as formed into the outline of a golf green, a key and a heart. The compressed fabric article contains a hole for storing an object. Such compression of the fabric article is well known and need not be described further. A flat sheet insert containing a picture of the familiar object may or may not be placed on the compressed fabric article. The flat sheet inserts contains a opening to reveal the hole located in the fabric article. An object is then inserted into the hole and the fabric article is wrapped in a transparent wrapping to create the promotional package. Therefore, in the preferred embodiment, the invention involves a compressed fabric article containing a hole. In yet another preferred embodiment, also illustrated in the Figures, the shape of the inserted object conforms to the shape of the hole.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

A promotional package of the preferred embodiment of the present invention includes a compressed fabric article formed into the shape of a familiar object. The compressed fabric article contains a hole for storing an object which is generally located in the center of the compressed fabric article, but may be located towards one particular side of the fabric article. A flat sheet in the shape of the compressed fabric article may or may not be placed over surface of the fabric article. The flat sheet insert typically contains a picture of the familiar object and has an opening that corresponds to the location, shape and size of the hole in the compressed fabric article. However, the flat sheet insert may contain desired pictures or words. The object placed in the hole may or may not protrude above the surface of the compressed fabric article and the flat sheet, allowing the recipient to view the entire package. The object usually conforms to the shape of the hole. However, any object that can fit into the hole can be utilized. Many different ways to obtain the compressed fabric article containing a hole can be utilized, such as using a mold with a projection formed thereon or any other method known by those of skill in the art.

Figure 1:
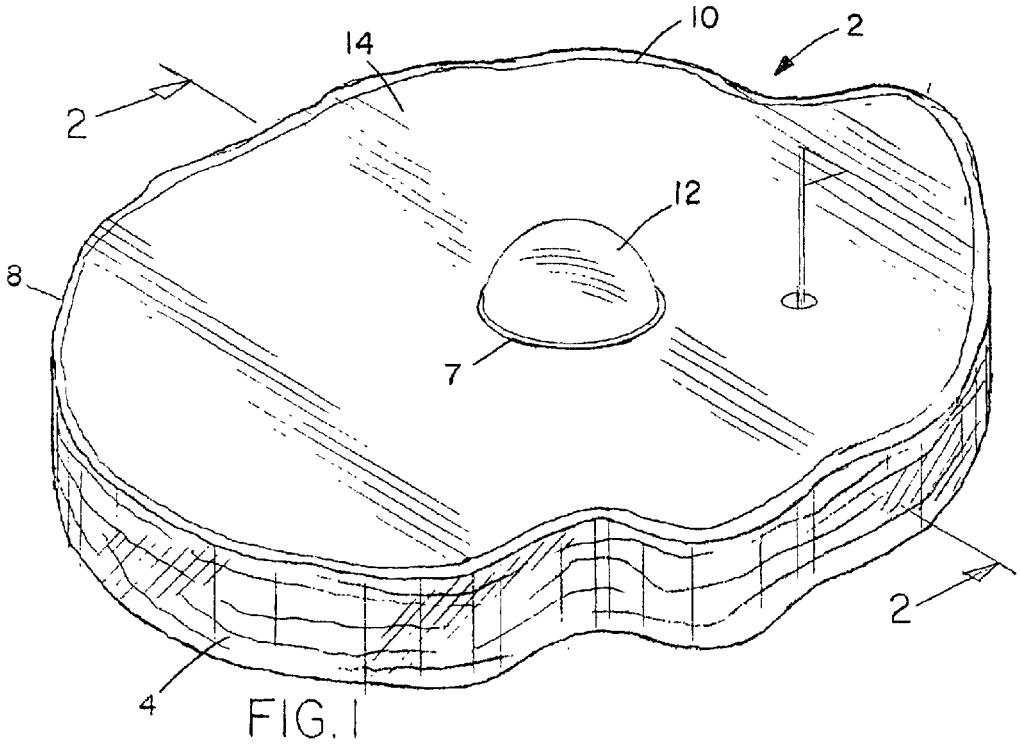
FIG. 1 is a perspective view of a promotional package in the in the shape of a golf green.
Figure 2:
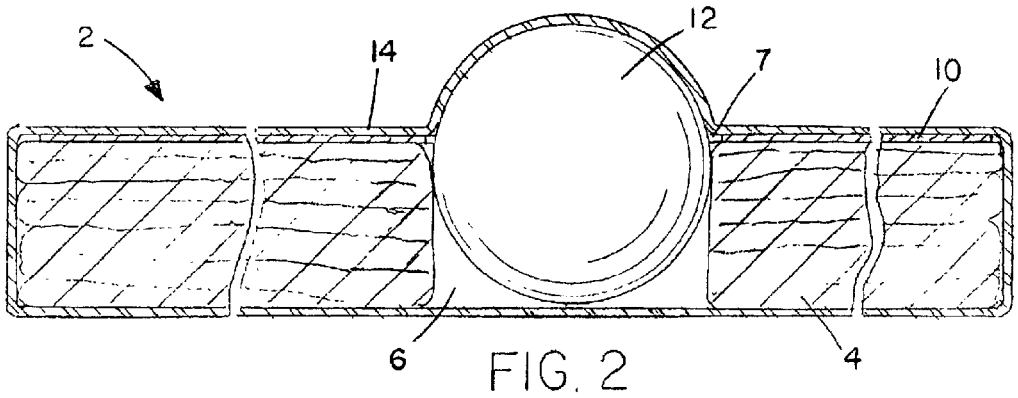
FIG. 2 is a cross-sectional view taken along line 2—2 of FIG. 1.

FIG. 1 shows a perspective view of a promotional package 2 that includes a compressed fabric article 4 in the shape of a golf green and contains a circular hole 6 for storing an object. A flat sheet insert 10 having a picture of a golf green, with an opening 7 in the same shape and location as the hole in the fabric article, is placed on the top surface 8 of the compressed fabric article 4. This will reinforce the recipient's recognition of the shape that the compressed fabric article 4 is intended to represent. An object 12, such as golf ball, or any other object capable of fitting in the hole 6, is then inserted in the hole 6. The top portion of the object may or may not protrude above the top surface of the compressed fabric article 4. The entire promotional package is then wrapped in a transparent or opaque wrapping 14 which maintains the object in the hole 6. FIG. 2 shows a cross-sectional view of the golf green promotional package of FIG. 1.

Figure 3:
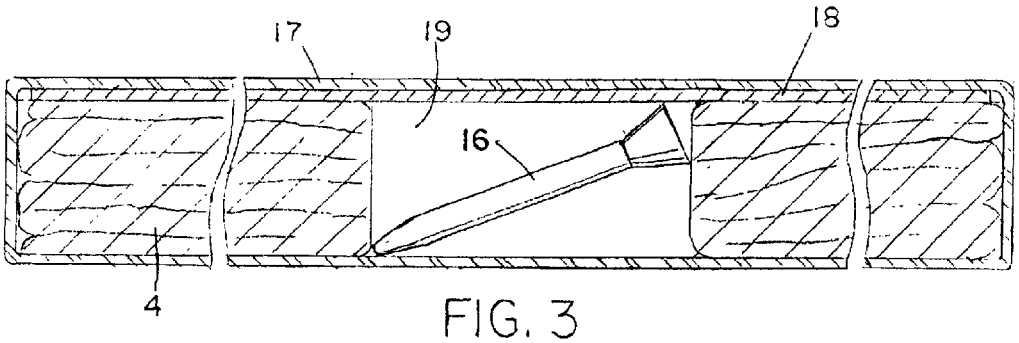
FIG. 3 is a cross-sectional view of a promotional package in the shape of a golf green containing a concealed object.

FIG. 3 shows a cross-sectional view of another embodiment of the promotional package that includes the compressed fabric article 4 containing a hole 19 in the shape of a golf green. In this embodiment, an object, such as a golf tee 16, is inserted inside the hole 19 and does not protrude above the top surface of the compressed fabric article. Although a golf tee 16 is shown, any object small enough to fit inside the hole 19 without protruding above the surface can be utilized. A solid flat sheet insert 18 having a picture of the golf green is placed on the top surface of the fabric article and a solid flat sheet insert, with or without a picture, is placed on the bottom surface of the fabric article. This conceals the hole and the golf tee. The entire promotional package is then wrapped in a transparent, or opaque wrapping 17. Once wrapped, a person does not know what, if anything, is concealed in the hole between the flat sheet inserts. In one option, the promotional package can be handed to individuals as part of a contest give away. Not all of the packages will contain an object and the individual with the package containing the object is the winner of the contest.

Figure 4:
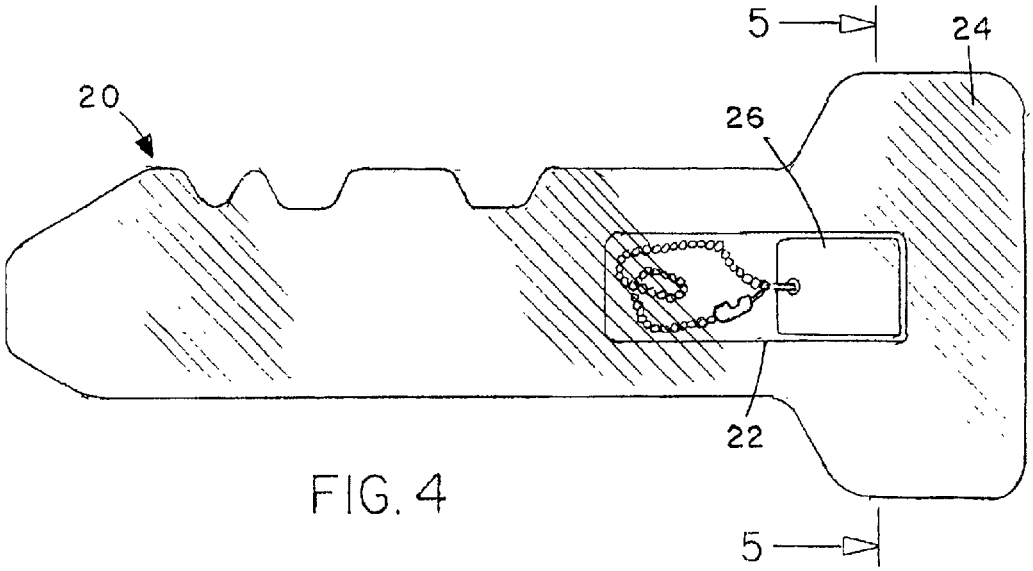
FIG. 4 is a top view of a promotional package in the shape of a key.
Figure 5:
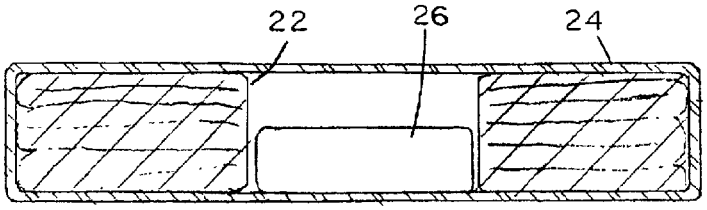
FIG. 5 is a cross-sectional view taken along line 5—5 of FIG. 4.

FIG. 4 shows a top view of a promotional package 20 with a compressed fabric article in the shape of a key containing a rectangular shaped hole 22 for storing an object. A flat sheet insert having a picture of the key or any other picture or words, with a rectangular opening cut out to reveal the hole 22, can be placed on a surface of the compressed fabric article. However, a key is a recognizable shape and a flat sheet insert may be left out of the promotional package. An object, such as a key chain 26, is then placed in the hole 22. Although the object 26 is shown wholly concealed within the fabric article, objects that protrude above the top surface may be utilized. The entire promotional package is then wrapped in a transparent or opaque wrapping 24 which maintains the object in the hole 22. FIG. 5 shows a cross-sectional view of the key shaped promotional package of FIG. 4.

Figure 6:
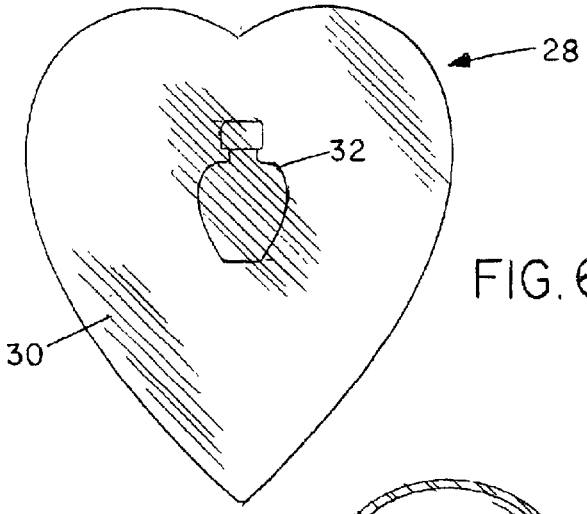
FIG. 6 is a top view of a promotional package in the shape of a heart.

FIG. 6 shows a top view of a promotional package with a compressed fabric article 28 in the shape of a heart containing a hole for storing an object. A flat sheet insert 30 having a picture of the heart or any other picture or words, with an opening in the same shape and location as the hole in the compressed fabric article may be placed on a surface of the compressed fabric article. However, a heart is a recognizable shape and a flat sheet insert may be left out of the promotional package. An object, such as a bottle of perfume 32 or any other object that can fit in the hole, is then placed in the hole. The top portion of the object may or may not protrude above the surface of the compressed fabric article. The entire promotional package is then wrapped in a transparent or opaque wrapping which maintains the object in the package. FIG. 5 shows a cross-sectional view of the heart promotional package of FIG. 6. Note that in this embodiment the hole and the object, the bottle 32, have substantially the same shape, insofar as the fabric shape can be conforming. In other embodiments, the hole may have a wide variety of shapes including a star, a diamond or a square.

Figure 7:
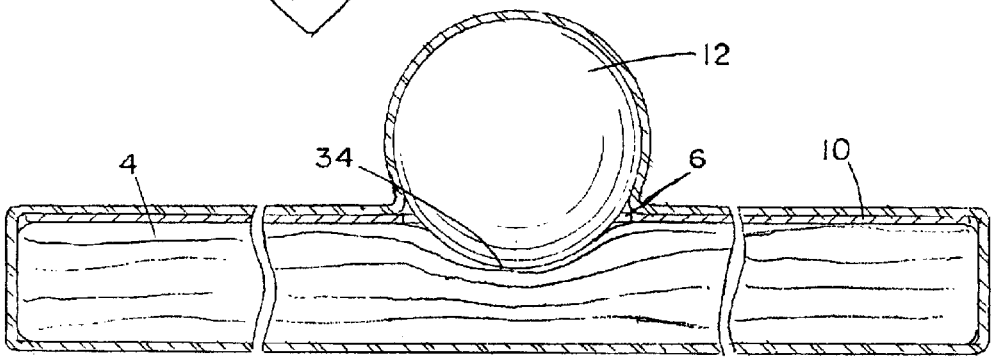
FIG. 7 is a cross-sectional view of a promotional package containing a small recess.

FIG. 7 shows a cross-sectional view of yet another embodiment. In this embodiment, the compressed fabric article 4 contains a circular recess 34 impressed on the top surface for storing an object. A flat sheet insert 10, having a picture of the golf green with an opening 7 in the same shape and location as the recess 34 in the compressed fabric article is placed on the top surface of the fabric article. An object, such as a golf ball 12, is then placed in the recess 34 with the top portion protruding above the top surface of the fabric article 4. The entire promotional package is then wrapped in a transparent or opaque wrapping. The recess 34 is relatively small, the depth does not exceed 0.25". Many different ways to obtain the recess can be utilized, such as embossing the recess in the fabric article, using a mold with a projection formed thereon or any other method known by those of skill in the art.

It will be apparent to those skilled in the art that the compressed fabric article and the hole or recess in the compressed fabric article may have a wide variety of shapes and sizes and that objects having a wide variety of shapes and sizes may placed in the hole or recess when practicing the present invention. For example, while a perfume bottle is shown as the object in the hole in FIG. 6, other objects including a small liquor bottle or candy may be placed in the hole.

As indicated with reference to the figures, the compressed fabric article is wrapped to form the desired product package. The wrapping is typically transparent (although it need not be devoid of color and can be opaque) so that the object contained in the hole of the compressed fabric article can be viewed. Usually the wrapping will be applied by compression wrapping with a stretched elastic wrapping film (such as polymeric material), but it could also be applied by shrink wrapping with a shrinkable film which is heated after wrapping to effect the shrinkage. Such wrapping is conventional for compressed fabric products and the use of the conventional techniques will not be affected by the presence of the object in the hole or recess, except that objects protruding above the surface of the fabric article may be flattened somewhat if there is high tension imparted to the film by its shrinkage or resilient elasticity.

The compressed fabric articles of the present invention may be formed from any desired fabric item, to which of course they revert once the compressed package is opened by the recipient. Such items may be garments such as shirts, blouses, scarfs, handkerchiefs, socks or the like; utility items such as towels, face cloths, wiping cloths, dust covers and the like; or other fabric items such as flags, banners and wall hangings. Other suitable products will be readily apparent to those skilled in the art. Since in most cases the compressed articles will be used as promotional items, the final compressed packages are usually relatively small, commonly having a largest dimension of 12–15 inches (30–38 cm) or less. However, it is contemplated that the present invention also includes adding holes to larger compressed fabric articles, since such will require no more than routine scale-up of the hole of smaller articles. Similarly, while it is preferred that the fabric items be entirely of cloth or synthetic fabric with no attachments such as buttons, fabric with such attachments is fully contemplated within this invention. This can be easily accomplished by appropriate planning of the initial folding of the fabric item so that the buttons or other attachments do not get broken during compression of the fabric article.

Although an exemplary embodiment of the invention has been described above by way of example only, it will be understood by those skilled in the field that modifications may be made to the disclosed embodiment without departing from the scope of the invention, which is defined by the appended claims.

I claim:

1. A promotional package comprising:

a compressed fabric article containing a hole;

said hole having an object inserted therein; and said package covered with a wrapping to display said object.

2. The package of claim 1, wherein said object is shaped to conform to the shape of said hole.

3. The package of claim 2, further comprising a flat sheet insert on said surface.

4. The package of claim 2, wherein said compressed fabric article is comprised of a woven or felted cloth.

5. The package of claim 4, wherein said woven or felted cloth article comprises a garment, utility item, flag, banner or wall hanging.

6. The package of claim 5, wherein said garment comprises a shirt, blouse, scarf, handkerchiefs or socks.

7. The package of claim 5, wherein said utility item comprises a towel, face cloth, wiping cloth or dust cover.

8. The package of claim 7, wherein said object is visible from outside said wrapping.

9. The package of claim 8, wherein said wrapping is opaque.

10. The package of claim 8, wherein said wrapping is transparent.

11. The package of claim 9, wherein said wrapping is transparent.

* * * * *